US006826377B2

(12) United States Patent
Kitozaki

(10) Patent No.: US 6,826,377 B2
(45) Date of Patent: Nov. 30, 2004

(54) POWER UNIT AND IMAGE FORMING APPARATUS PROVIDED WITH SAME MOUNTED THERETO

(75) Inventor: Yukihiro Kitozaki, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 110 days.

(21) Appl. No.: 10/118,960

(22) Filed: Apr. 10, 2002

(65) Prior Publication Data

US 2002/0168197 A1 Nov. 14, 2002

(30) Foreign Application Priority Data

Apr. 11, 2001 (JP) ..... 2001-112453
Apr. 8, 2002 (JP) ..... 2002-105038

(51) Int. Cl.[7] ..... G03G 15/00
(52) U.S. Cl. ..... 399/88

(58) Field of Search ..... 174/52.1, 59; 361/724, 361/725, 730, 731, 807, 809; 399/88, 90, 107, 110

(56) References Cited

U.S. PATENT DOCUMENTS 5,918,089 A * 6/1999 Malinich et al. ..... 399/90

* cited by examiner

*Primary Examiner*—Hoang Ngo
(74) *Attorney, Agent, or Firm*—Fitzpatrick, Cella, Harper & Scinto

(57) ABSTRACT

An electric power unit for an option apparatus selectively mountable to an image forming apparatus, wherein the power unit is mounted to the image forming apparatus with mounting of the option apparatus, includes an electric power generating portion for generating electric power; and a connector for connection with the option apparatus to supply electric power from the electric power generating portion to the option apparatus.

5 Claims, 11 Drawing Sheets

POWER UNIT AND IMAGE FORMING APPARATUS PROVIDED WITH SAME MOUNTED THERETO

FIELD OF THE INVENTION AND RELATED ART

The present invention relates to a power unit and an image forming apparatus to which the power unit is mounted. The power unit is usable with an image forming apparatus using an electrophotographic type, electrostatic recording type or the like process. The power unit is optionally installed in the image forming apparatus such as a copying machine, printer or the like when the user desires.

Referring to FIGS. 9 and 10, a conventional example will be described.

In this conventional example, the main assembly 110A comprises an original reading station (reader apparatus) 105A and an image formation station (printer) 106A.

The copying image formation will be briefly described. Image information is obtained by scanning an original using the reader apparatus 105A. A photosensitive member is uniformly charged by charging means, and the surface of the photosensitive member is exposed to the image information by exposure means to form an electrostatic latent image to develop the electrostatic latent image by a developing device. A recording paper is fed from a sheet feeding cassette 1 disposed at a lower portion of the main assembly, and the developed image provided by the developing device is transferred onto the recording paper by transferring means. The recording paper now having the image transferred thereonto is fed to a fixing device, which fixed the image on the recording paper and discharges the recording paper to the outside.

The description will be made as to conventional structure around a power unit which is an option apparatus (option voltage source) detachable to the main assembly of the image forming apparatus.

FIG. 9 is a rear view of the option apparatus and the main assembly of the image forming apparatus. Designated by 110A is the main assembly of the image forming apparatus; 111A is an original feeder apparatus which is one kind of an option apparatus for feeding an original to be copied to the image reading station; 112A is a cassette pedestal apparatus which is one kind of an option apparatus for feeding sheets to the image forming apparatus, the cassette pedestal apparatus being provided with a sheet feeding device and a sheet feeding cassette described in conjunction with FIG. 6; 113A is paper-deck apparatus which is one kind of an option apparatus for feeding sheets to the image forming apparatus, the paper-deck apparatus 113A having a function of feeding the sheets; 114A is a finishing apparatus which is an option apparatus for aligning, stapling and/or sorting the sheets discharged from the main assembly of the image forming apparatus; 115A is a first voltage source cable for supplying electric power to the feeder apparatus 111A from the main assembly 110A of the apparatus; 116A is a first connector for connecting the first voltage source cable 115A to the main assembly of the apparatus; 117A is a second voltage source cable for supplying electric power from the main assembly 110A of the apparatus to the cassette pedestal apparatus 112A; 118A is a second connector for connecting the second voltage source cable 117A to the main assembly of the apparatus; 119A is a third voltage source cable for supplying electric power to the paper deck apparatus 113A from the main assembly 110A of the apparatus main assembly of the apparatus; 120A is a third connector for connecting the third voltage source cable 119A to the main assembly of the apparatus; 121A is a fourth cable for supplying electric power to the finishing apparatus 114A from the main assembly 110A of the apparatus; 122A is a fourth connector for connecting the fourth voltage source cable 121A to the main assembly of the apparatus; and 123A in an outer casing of the main assembly of the apparatus. The first, second, third and fourth connectors are disposed in the main assembly 100A of the copying image forming apparatus.

FIG. 10 shows an inside of the main assembly of the apparatus, omitting the outer casing 123A. In FIG. 10, designated by 124A is a main voltage source for supply 24V in the main assembly 110A of the apparatus; 125A is a low and high voltage source for supplying a low voltage not more than 23V such as 3, 5, 13V or the like and a high voltage such as not less than 100V in the main assembly of the apparatus; 126A is a DC voltage source for supplying a starting and stopping signal to each of the driving source in the main assembly of the apparatus in FIG. 10; and 107A is a reader controller for controlling an original reading operation of the main assembly of the apparatus.

Here, the cassette pedestal apparatus 112A is supplied with a control signal from the DC voltage source 126A of the main assembly of the apparatus and with electric power from the low and high voltage source (124A, 125A) through the second connector 118A and the second voltage source cable 117A. Designated by 127A is an option voltage source, detachable to the main assembly 110A of the apparatus, for providing a voltage source (24V, 5V or the like) for driving each of the option apparatus (11A, 113A, 114A). Driving. The option voltage source 127A is disposed adjacent the original feeder apparatus 111A which is most often used among the option apparatuses (111A, 113A, 114A) except for the cassette pedestal apparatus 112A. The original feeder apparatus 111A is supplied with a control signal from the reader controller 107A and with the driving electric power from the option voltage source through the first connector 116A and the first cable 115A. The paper deck apparatus 113A and the finishing apparatus 114A are supplied with a control signal from the DC voltage source 126A and with the driving electric power from the option voltage source through the third and fourth connectors (120A, 122A) and the third and fourth cables (119A, 121A).

Depending on the structure of the option voltage source, (1) the cassette pedestal apparatus 112A may be supplied with the electric power from the option voltage source 127A, (2) some of the option apparatuses (111A, 112A, 113A, 114A) may be supplied with electric power from the main voltage source 124A of the main assembly, and the other may be supplied with the option voltage source.

As shown in FIGS. 9, 10, in the conventional structure, the option voltage source 127A is detachable relative to the main assembly 110A of the apparatus, and it is loaded in the main assembly of the apparatus only when an option apparatus to be driven by the option voltage source 127A. By doing so, the cost of the main assembly 110A is lowered, and the user not requiring the option apparatus is free from additional cost. In addition, by reducing the number of cables directly connected to the electrical outlet, the number of change devices required for permitting use in areas providing different voltages, can be reduced.

However, in a conventional system, the electric power is supplied from one option voltage source to all of the option apparatuses. Therefore, the original feeder apparatus and the cassette pedestal apparatus which are relatively frequently used and the cassette deck and the finishing apparatus which are relatively less frequently used, are supplied with the electric power from the same option voltage source. This is so in order to reduce the cost of the main assembly of the apparatus. Despite the fact that it is intended to reduce the cost imparted to the user not requiring the option apparatus, the option voltage source apparatus is such as to cover all of the option apparatuses, and therefore, is expensive. For example, the same option voltage source apparatus has to be used even when the original feeder apparatus and/or the cassette pedestal is used, but the cassette deck or finishing apparatus is not used. The connector (116A, 118A, 120A, 122A) to which the conventional option apparatus (111A, 112A, 113A, 114A) is connected, is disposed at a position close to the option apparatus away from the option voltage source. Therefore, when the option voltage source is mounted to the main assembly of the apparatus, a connector to which the option apparatus is connected has to be installed, with the result of time consuming operations. In another case, the connector is provided in the main assembly of the apparatus irrespective of whether the option apparatus is mounted or not. This leads to cost increase of the main assembly of the apparatus, and therefore, the advantage of the option voltage source apparatus intended to reduce the cost is not provided enough.

SUMMARY OF THE INVENTION

Accordingly, it is a principal object of the present invention to provide a power unit and an image forming apparatus to which the power unit is mounted, wherein an operativity upon mounting is high.

It is another object of the present invention to provide an image forming apparatus with which the cost is reduced with the high operativity upon the mounting of the power unit.

It is a further object of the present invention to provide an electric power unit for an option apparatus selectively mountable to an image forming apparatus, wherein the power unit is mounted to the image forming apparatus with mounting of the option apparatus, includes an electric power generating portion for generating electric power; and a connector for connection with the option apparatus to supply electric power from the electric power generating portion to the option apparatus.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 3:
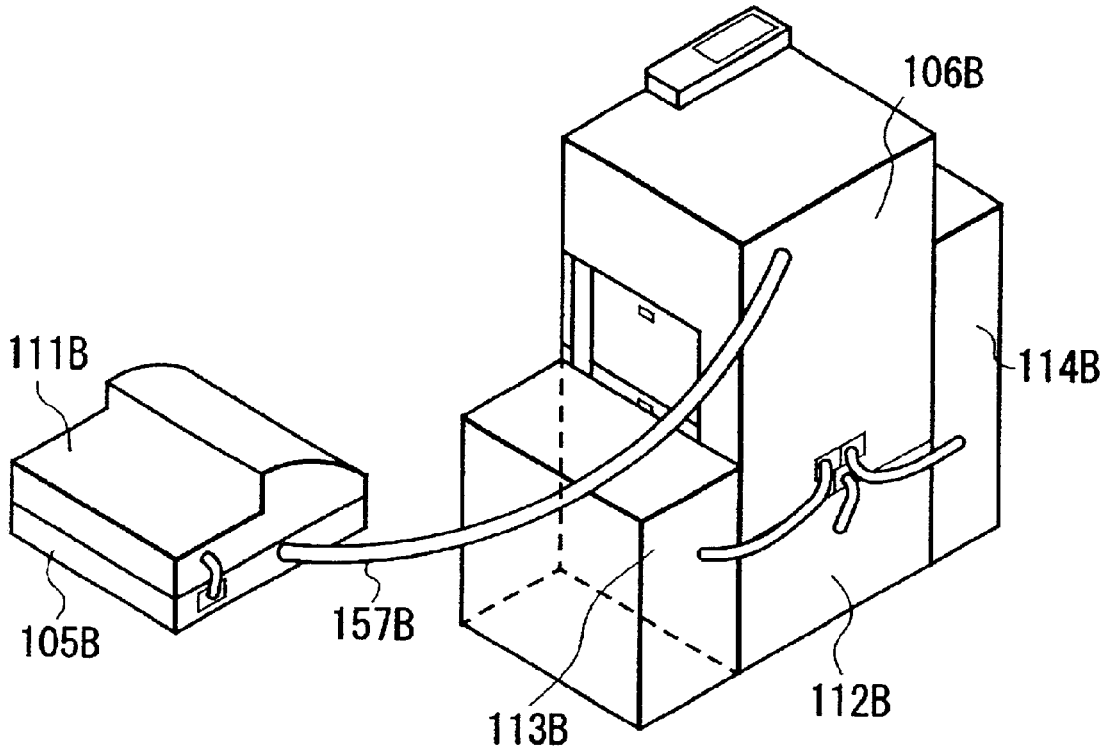
FIG. 3 is a perspective view illustrating separation and connection between the reader apparatus and the printer.

Referring to FIG. 3, the description will first be made as to a general arrangement of the main assembly of the image forming apparatus.

An original is placed on an original glass 201, and a copy key is depressed, in response to which the original exposure device 202 moves in the direction indicated by arrow A while illuminating the original to scan the whole surface of the original. The light reflected by the original in the original exposure device 202, is folded by second and third mirror 203 v and is image on a CCD204 by a lens. The original read by the CCD204 is converted to an electric signal in the image processor, and is supplied to a laser scanner 100. Then, image light corresponding to the image information from the laser scanner 100 is scanned by an image writing optical system and is image on the photosensitive drum 101 to form an electrostatic latent image. The electrostatic latent image is developed by a developing device 102.

On the other hand, recording sheets are accommodated in a sheet feeding cassette 1 disposed at a lower portion of the image forming apparatus. When the sheet feeding cassette 1 is set in the main assembly of the apparatus, an unshown lifter motor is operated to raise the sheet in the sheet feeding cassette 1 to enable sheet supply. The recording paper starts to move by rotation of the sheet feeding roller 2 and is fed out in seriatim by the function of a pair of separation rollers 3 and 4, and is fed to a pair of registration rollers 7, 8 through a pair of downstream feeding rollers 5, 6.

The recording paper adjusted by the registration rollers 7, 8 relative to the image on the photosensitive member, is fed to the transfer portion where the image provided by development of the developing device 102 is transferred onto the recording paper by the transfer roller 103 from the photosensitive drum 101. The recording paper now having the transferred image is separated from the photosensitive drum 101 by a separation charger.

It is fed through a feeding portion 10 to a fixing device 11 where the image on the recording paper is fixed, and then, the recording paper is discharged to outside the apparatus by sheet discharging rollers 12, thus completing the copy operation.

Figure 1:
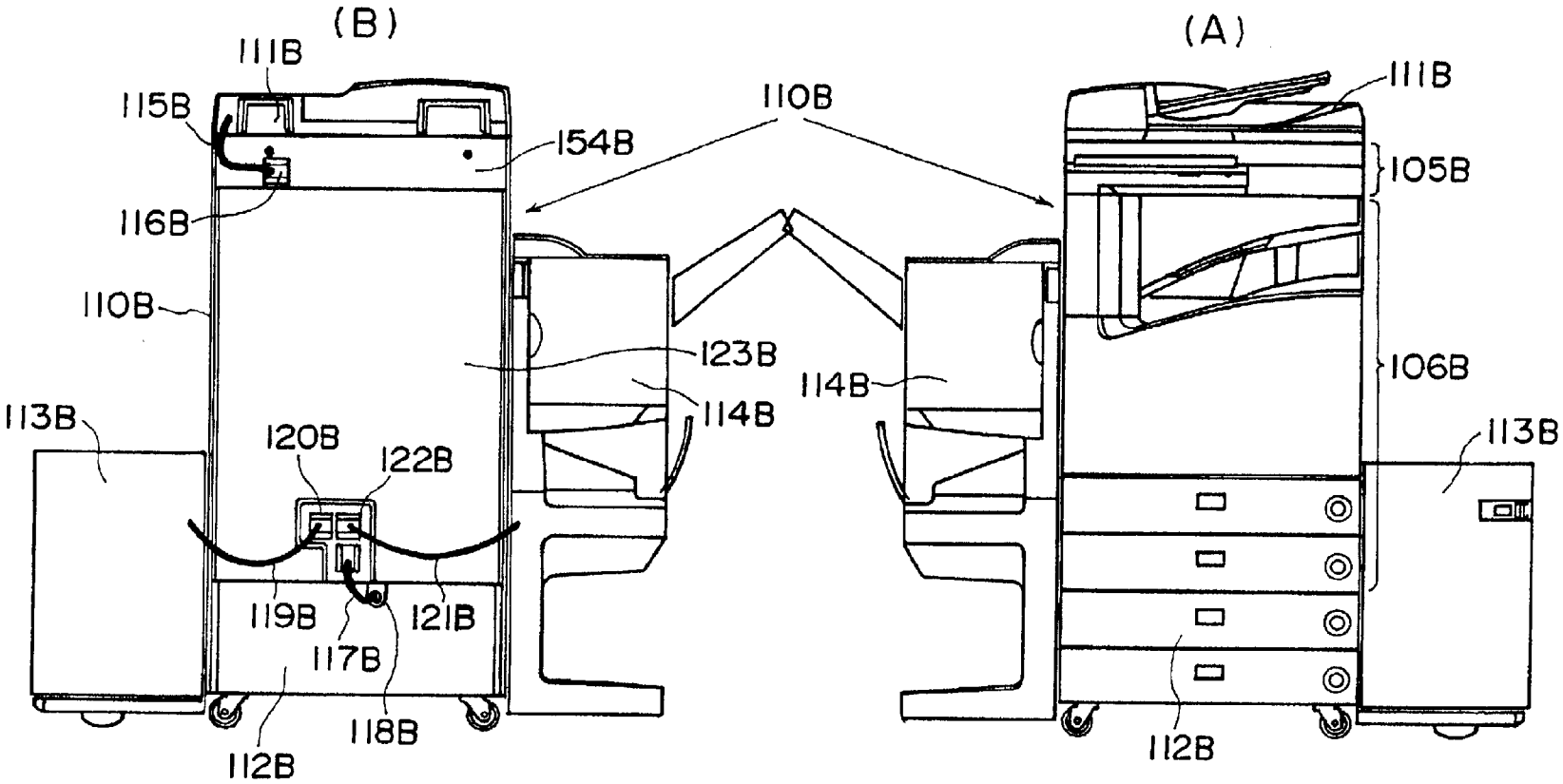
FIG. 1 is a front view of an image forming apparatus loaded with an option apparatus according to an embodiment of the present invention (A), and a rear view thereof (B).

Referring to FIGS. 1–7, the description will be made as to the structure of the option voltage source. FIG. 1 shows the main assembly of the image forming apparatus to which the option apparatus is mounted, and (A) is a front view, and (B) is a rear view. The main assembly 110B of the copying image forming apparatus is constituted by image reading apparatus (reader apparatus) 105B for reading an image and an image forming apparatus (printer) 106B for forming an image in accordance with an image signal supplied from the reader apparatus or a computer or the like. Recently, the image forming apparatus is digitalized increasingly, and therefore, it becomes not necessary that original reading station and the image formation station are integral. The reader apparatus and the printer are made separate from each other, and are combined with high latitude of arrangements to permit a handicaped person to freely arrange them and to accomplish larger assortment of items to meet individual needs.

Designated by 111B is an original feeder apparatus which is one of the option apparatuses and which functions to feed the original to the image reading station; 112B is a cassette pedestal apparatus which is one of the option apparatuses and which functions to feed the sheet to the image forming apparatus, the cassette pedestal apparatus having a sheet feeding cassette and a sheet feeding device; 13B is one of the option apparatuses for feeding the sheet to the image forming apparatus. The cassette pedestal apparatus and the paper deck apparatus are recording material supplying device for supplying the recording material. Designated by 114B is a finishing apparatus which is one of the option apparatuses and which functions to align, staple and/or sort the sheets discharged from the main assembly of the image forming apparatus; 115B is a first voltage source cable for supplying electric power to the feeder apparatus 111A from the main assembly of the apparatus; 116B is a first connector for connecting the first voltage source cable 115B to the main assembly of the apparatus; 117B is a second voltage source cable for supplying the electric power to the cassette pedestal apparatus 112B from the main assembly 110B of the apparatus; 118B is a second connector for connecting the second voltage source cable 117B to the main assembly of the apparatus; 119B is a third voltage source cable for supplying the electric power to t paper deck apparatus 113B from the main assembly 110B of the apparatus; 120B is a third connector for connecting the third voltage source cable 119B to the main assembly of the apparatus; 121B is a fourth voltage source cable for supplying the electric power to the finishing apparatus 114B from the main assembly 110B of the apparatus; 122B is a fourth connector for connecting the fourth voltage source cable 121B to the main assembly of the apparatus; and 123B, 154B are outer casings of the main assembly of the apparatus.

Figure 2:
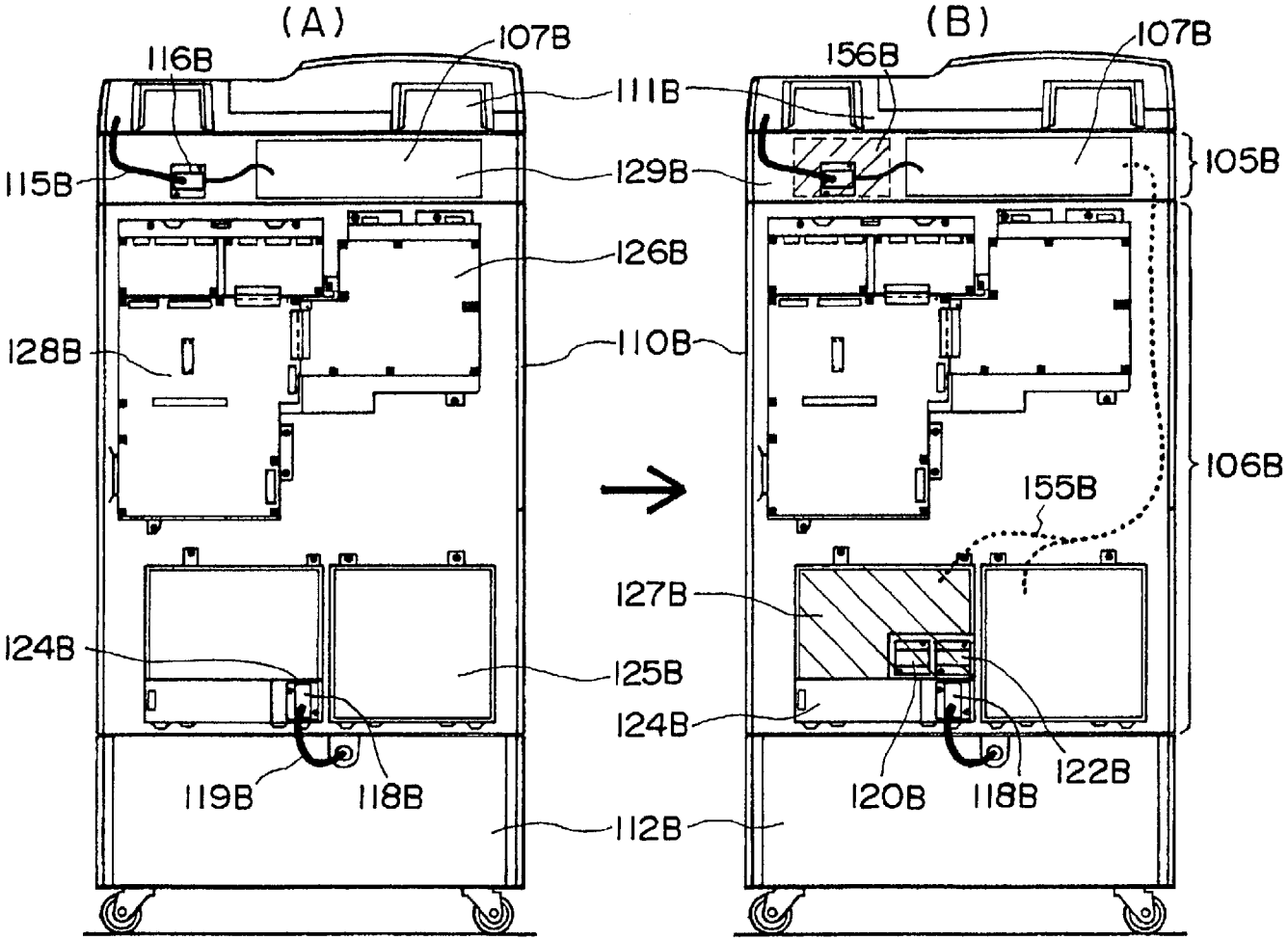
FIG. 2 is a rear view in which the option voltage source is not loaded (A), and the option voltage source is mounted to the apparatus.

FIG. 2 is a rear view of the main assembly 110B of the apparatus with the outer casings 123B, 154B omitted, and (A) shows the state in which the option voltage source is not loaded, and (B) shows the state in which the option voltage source 127B (hatched portion) is loaded. Designated by 128B is a control board for controlling the main assembly 110B of the apparatus; 124B is a main voltage source for supplying 24V in the main assembly 110B of the apparatus; 125B is a low and high voltage source for supplying a voltage not more than 23V such as 3, 5, 13V and a high voltage higher than 100V in the main assembly of the apparatus; 126B is a DC voltage source for supplying a starting and stopping signals to the respective driving sources in the main assembly of the apparatus described with respect to the conventional example. First, a connection type of the feeder 111 B will be described. Feeder apparatus 111B functions to feed the originals to the image reading means provided in t reader apparatus 105B. The feeder apparatus 111B is provided in the reader apparatus 105B, even when the reader apparatus and the printer are separate. In consideration of the possibility that reader apparatus is frequently disposed on the printer and that reader apparatus is disposed away from the printer for convenience of the disabilities, it is desirable that electric power is supplied thereto separately from the supply of the electric power to the finishing apparatus or t paper deck normally disposed juxtaposed with the printer, since then, it is not necessary to consider the length of the cable and the position of the option power unit is flexible. By making the option apparatus interrelated with the printer 106B and the voltage source for the feeder apparatus 111B separation from each other, the necessity for the provision of the voltage source for the unnecessary paper deck or the finishing apparatus can be avoided.

In this embodiment, the feeder apparatus 111B is supported on the top of the reader apparatus 105B, and is supplied with a control signal and electric power for operating the feeder apparatus 111B from the reader controller 107B in th reader apparatus 105B through the first connector 116B and the first cable 115B. Therefore, the length of t first cable 115B is short so that radiation noise can be reduced. In the example, the reader apparatus 105B is not disposed away from the printer 106B, but is disposed at the top of the printer 106B (the utilization rate of the feeder 111B is as high as 50%), and therefore, the electric power for the feeder apparatus 111B is supplied from the main assembly 110B. But, it is a possible alternative to supply the electric power to the feeder apparatus 111B through the reader apparatus 105B as indicated by broken lines in (B) of FIG. 2.

When the voltage supply to the feeder apparatus 111B is desired to be optional, the second option voltage source 156B detachably mountable into the reader apparatus 105B may be connected. In such a case, the first connector 116B may be provided in the second option voltage source, and then, the first connector is optional depending on the necessary property of the feeder apparatus 111B, as is advantageous from the product cost.

The reader apparatus can be said as being one of the option apparatuses provided in the printer. The utilization ratio of the reader apparatus is also high. When it is disposed at the top of the printer, it may be supplied with the electric power from the main assembly of the printer. When it is separated from the printer, or the utilization ratio is low, the electric power is preferably supplied separately from the printer or option voltage source. As regards the paper deck apparatus 113B and the finishing apparatus 114B, the utilization ratio is as low as not more than 30% in the case of the image forming apparatus having a copy speed of not more than 50 per minute, and therefore, the option voltage source 127B is used as a voltage source for driving them (24V, 5V or the like). The paper deck apparatus and the finishing apparatus is disposed directly adjacent to the printer and is connected to a lower part of the printer at the rear side thereof, in many cases. Since, however, the voltage source is different from that for the feeder apparatus 111B, the option voltage source 127B can be disposed at a position lower than half height of the printer. Normally, the paper deck apparatus and the finishing apparatus are disposed at the opposite sides interposing the printer therebetween, and therefore, the option voltage source is preferably disposed neighborhood the central portion of a lower part of the printer. By doing so, the lengths of the third and fourth cable become short, and therefore, the radiation noise at the time of communication through the cable can be reduced, and the cable sandwiching at the time of JAM clearance can be attended. In addition, the option voltage source 127B can be provided with the third and fourth connectors, and therefore, the option power unit and the connector or provisions may be used in accordance with the users needs. This accomplishes cost reduction of the main assembly of the apparatus, and the connector is mounted to or demounted from the printer integrally y with the option voltage source. This improves the operativity.

The cassette pedestal apparatus 112B will be described. In this embodiment, the consideration is paid to the fact that utilization ratio of the cassette pedestal apparatus 112B is as high as not less than 50% in the market. The second connector 118B for connecting the cassette pedestal apparatus 112B to the main assembly 110B of the apparatus is provided in the main assembly 110B of the apparatus from the beginning, and the second connector 118B is fixed to the main voltage source 124B. In order to start the cassette pedestal apparatus 112B, the electric power is supplied from the main voltage source 124B and the low and high voltage source 125B, and the control signal is supplied from the DC voltage source 126B. By doing so, the necessity for providing the unnecessary voltage source for the option apparatus can be avoided, even if the cassette pedestal apparatus is used. It is often that cassette pedestal apparatus is disposed below the printer 106. If the probability of use of the paper deck apparatus 113B and the finishing apparatus is relatively high, the option power unit for supplying the electric power to the paper deck apparatus 113B and the finishing apparatus is provided with the connector for the cassette pedestal apparatus to permit supply of the electric power from the option power unit to the cassette pedestal apparatus. By doing so, the length of the cable is not made long, and therefore, the cost can be reduced, and the necessity for manipulation of mounting the connector can be omitted, with the result of improvement of the operativity.

As described in the foregoing, the voltage supply for the feeder apparatus 111B is effected separately from that for the paper deck apparatus, finishing apparatus or the cassette pedestal, and the option power unit for voltage supply for the paper deck apparatus 113A and the finishing apparatus 114B is detachably mountable to the printer 106B together with the integral connectors therefor. By this, a voltage source system is advantageous in the operativity and cost to meet the needs of the option apparatuses.

In addition, the separation structure between the reader apparatus 105B and the printer 106B is simple, and the reader apparatus 105B can be freely disposed. FIG. 3 shows an example in which the reader apparatus 105B and the feeder apparatus 111B are disposed at lower positions to permit easy manipulation by a user on a wheel chair. The reader apparatus 105B and the printer 106B are supplied with the electric power, separately from each other, and the feeder apparatus 111B is supplied with the electric power from the reader apparatus 105B. Between the reader apparatus 105B and the printer 106B, only a communication cable 157B is connected.

In addition, the length of the cable between the option apparatus and the main assembly of the apparatus is made short, so that low noise and low cost are accomplished.

Figure 4:
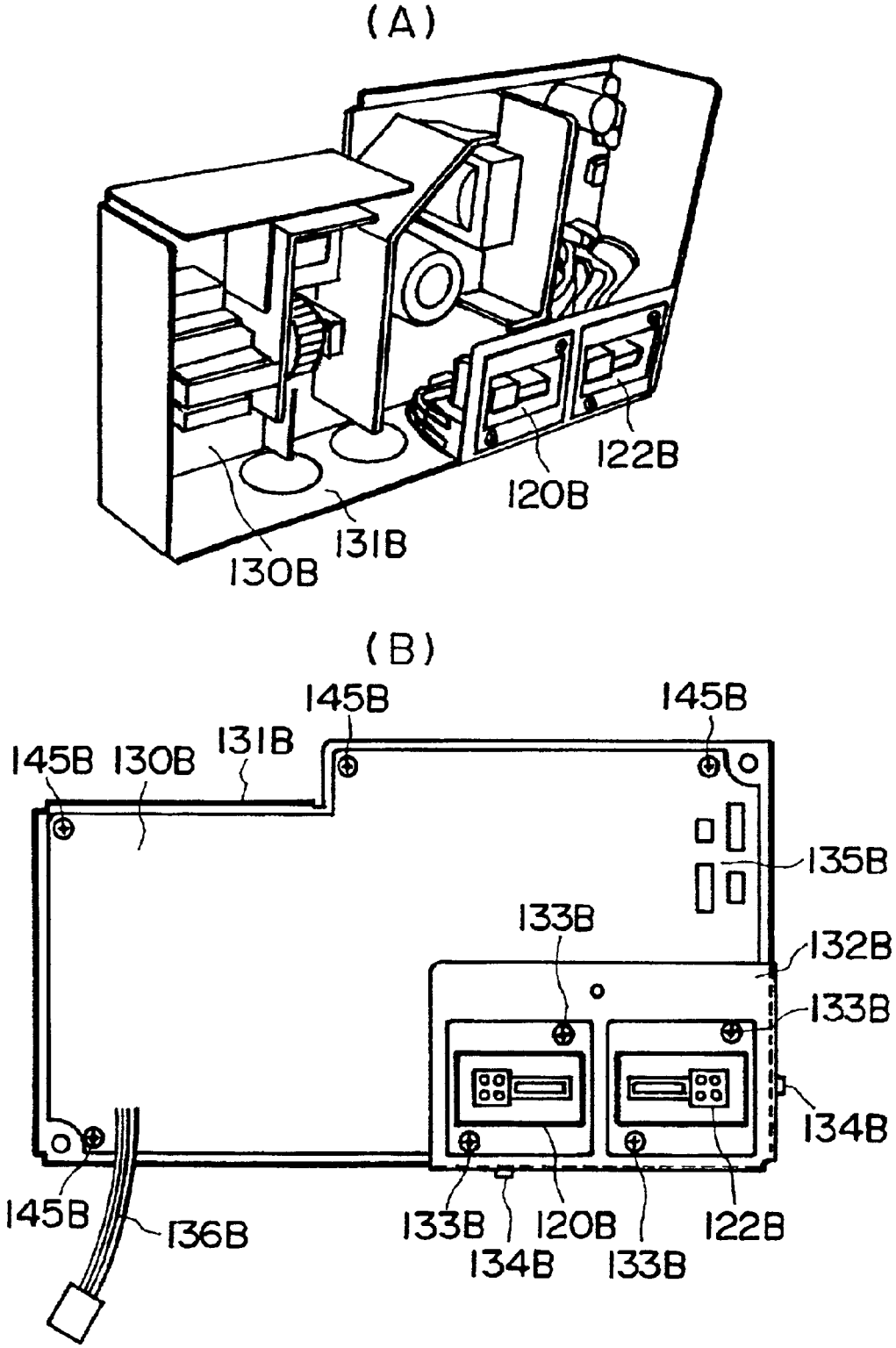
FIG. 4 shows the option voltage source of FIG. 2, and is a perspective view (A) and a front view in which a cover is mounted (B).
Figure 5:
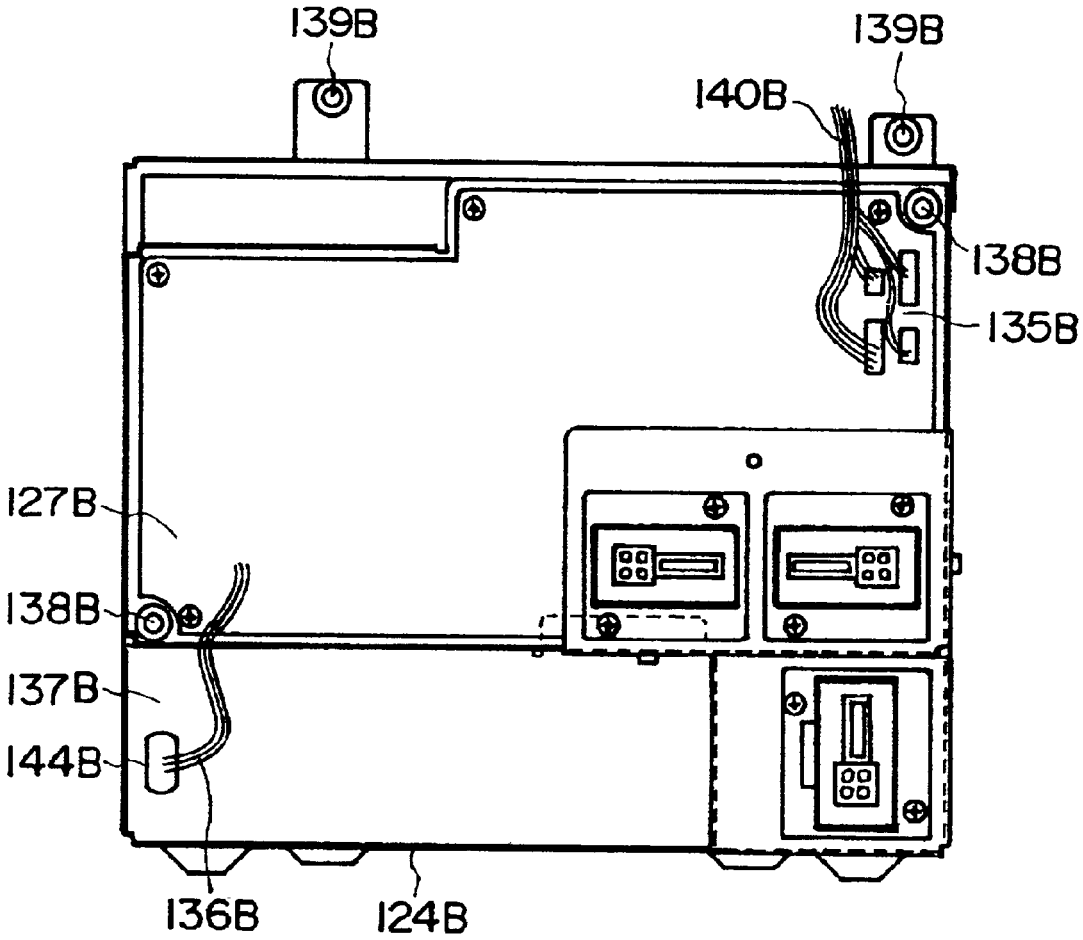
FIG. 5 is a front view in which the option voltage source of FIG. 2 is mounted to a main voltage source.

Referring to FIGS. 4 and 5, the option voltage source 127B will be described in detail. FIG. 4 is a perspective view of the option voltage source 127B (A) and a front view thereof (B). In FIG. 4, designated by 130B is a voltage source substrate for the electric power supply to the option apparatus, 131B is a first case metal plate for fixing the voltage source substrate 130B, 132B is a connector supporting plate which is fixed on the case metal plate 131B by screws 134B and on which the third connector 120B and the fourth connector 122B are fixed by screws 133B.

Designated by 135B is a fifth connector for supply of a remote signal from the control board 128B shown inn FIG. 2 and for supply of a signal of a connector from the DC voltage source 126B. Designated by 136B is a sixth voltage source cable for supply of a signal for generating 24V and 5V in the voltage source substrate 130B from the main voltage source 124B shown in FIG. 2. FIG. 5 shows an example in which the option voltage source 127B is loaded in the main assembly. The option voltage source 127B is fixed on the second case metal plate 137B of the main voltage source 124B by screws 138B.

The control board 128B and the fifth voltage source voltage source cable 140B from the DC voltage source 126B are connected to the fifth connector 135B, and the sixth voltage source cable 136B is connected to the main voltage source 124B through the second case metal plate 137B by the sixth connector 144B. The main voltage source 124B is fixed to the main assembly 110B of the apparatus by screws 139B as shown inn FIG. 2.

Figure 6:
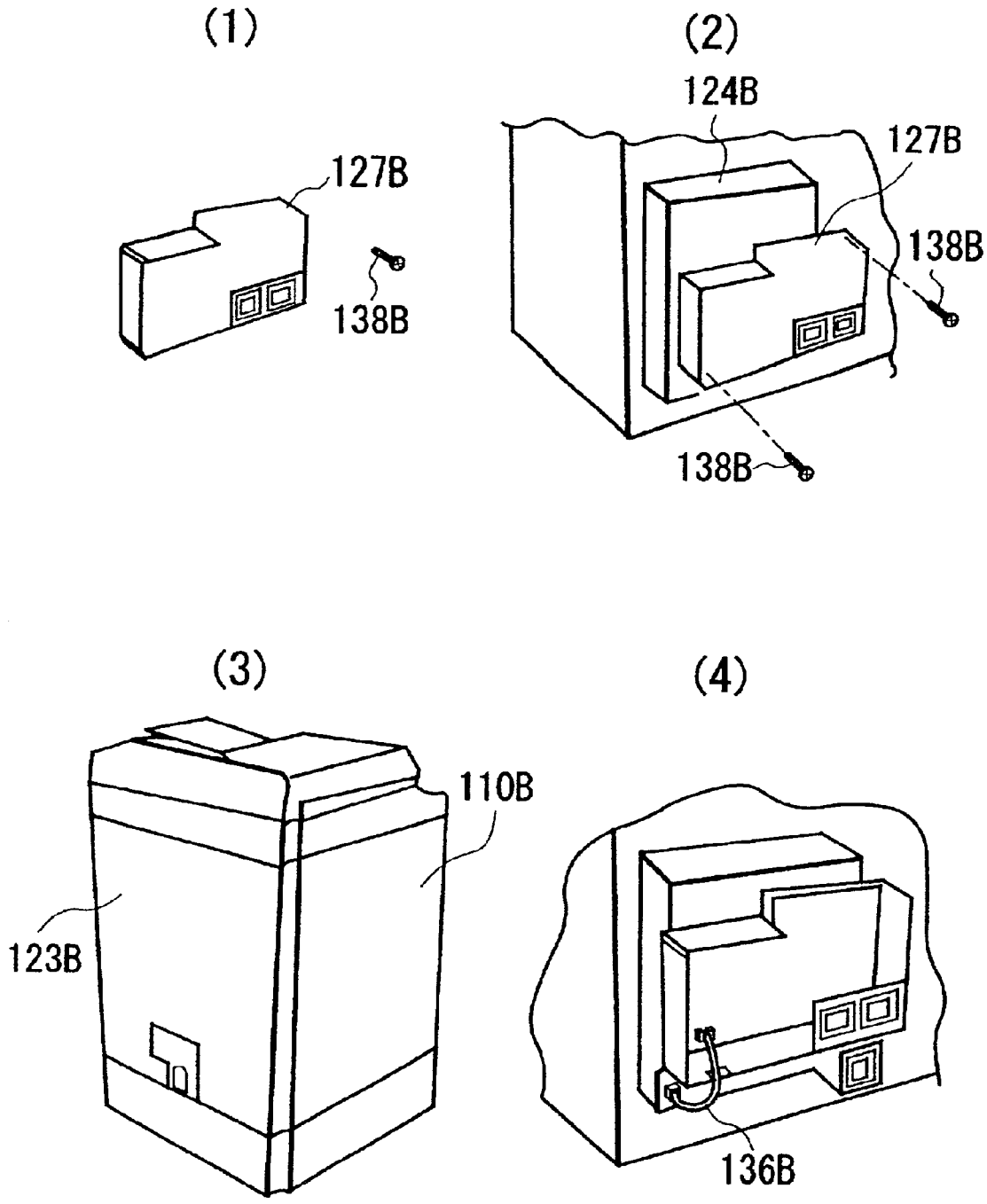
FIG. 6 is an illustration of mounting steps (1)–(4) of the option voltage source shown in FIG. 2.
Figure 7:
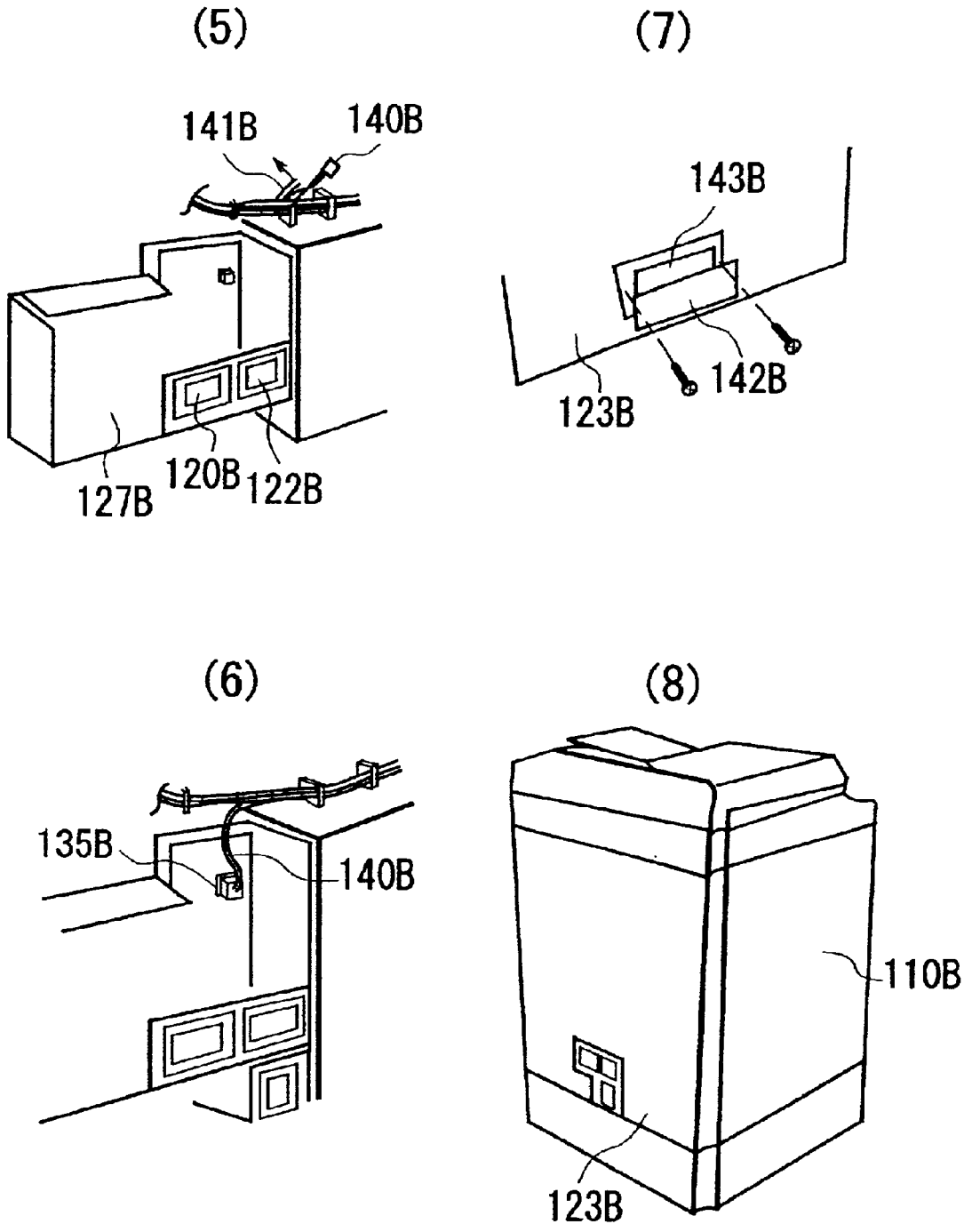
FIG. 7 is an illustration of mounting steps (5)–(8) of the option voltage source shown in FIG. 2.
Figure 8:
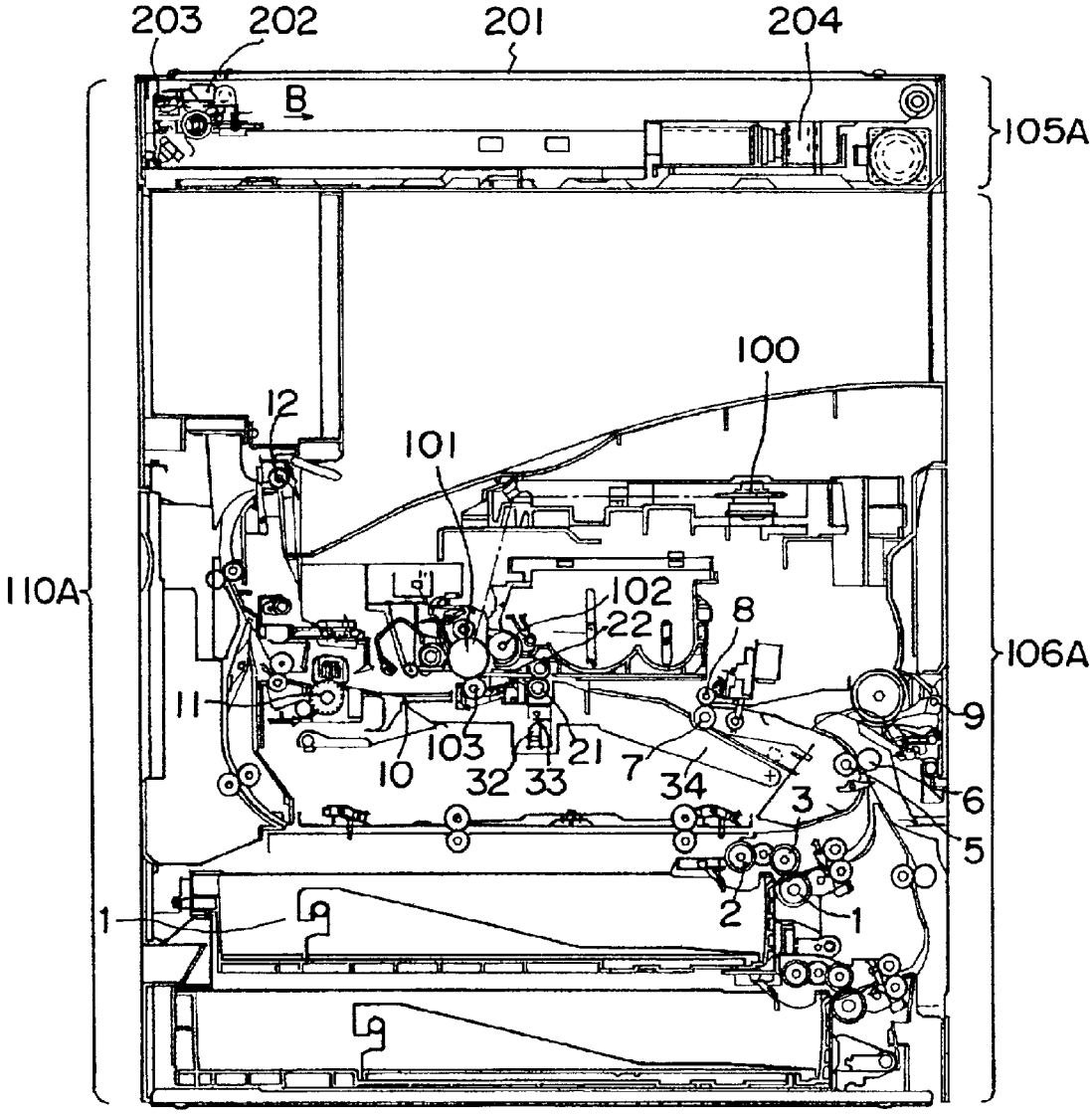
FIG. 8 is a schematic illustration of the image forming apparatus according to an embodiment of the present invention.
Figure 9:
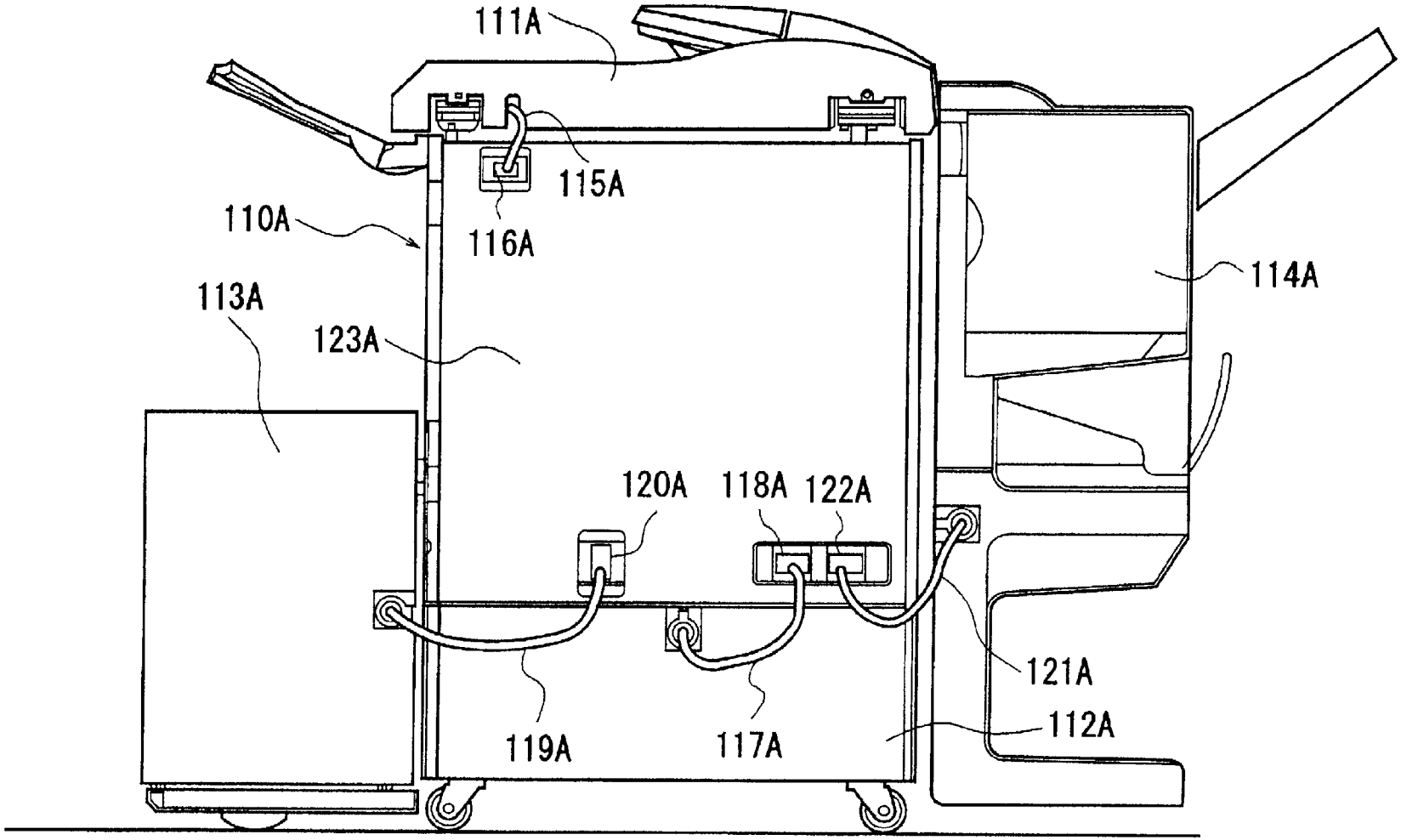
FIG. 9 is a rear view illustrating mounting of the option apparatus to the main assembly of a conventional image forming apparatus.
Figure 10:
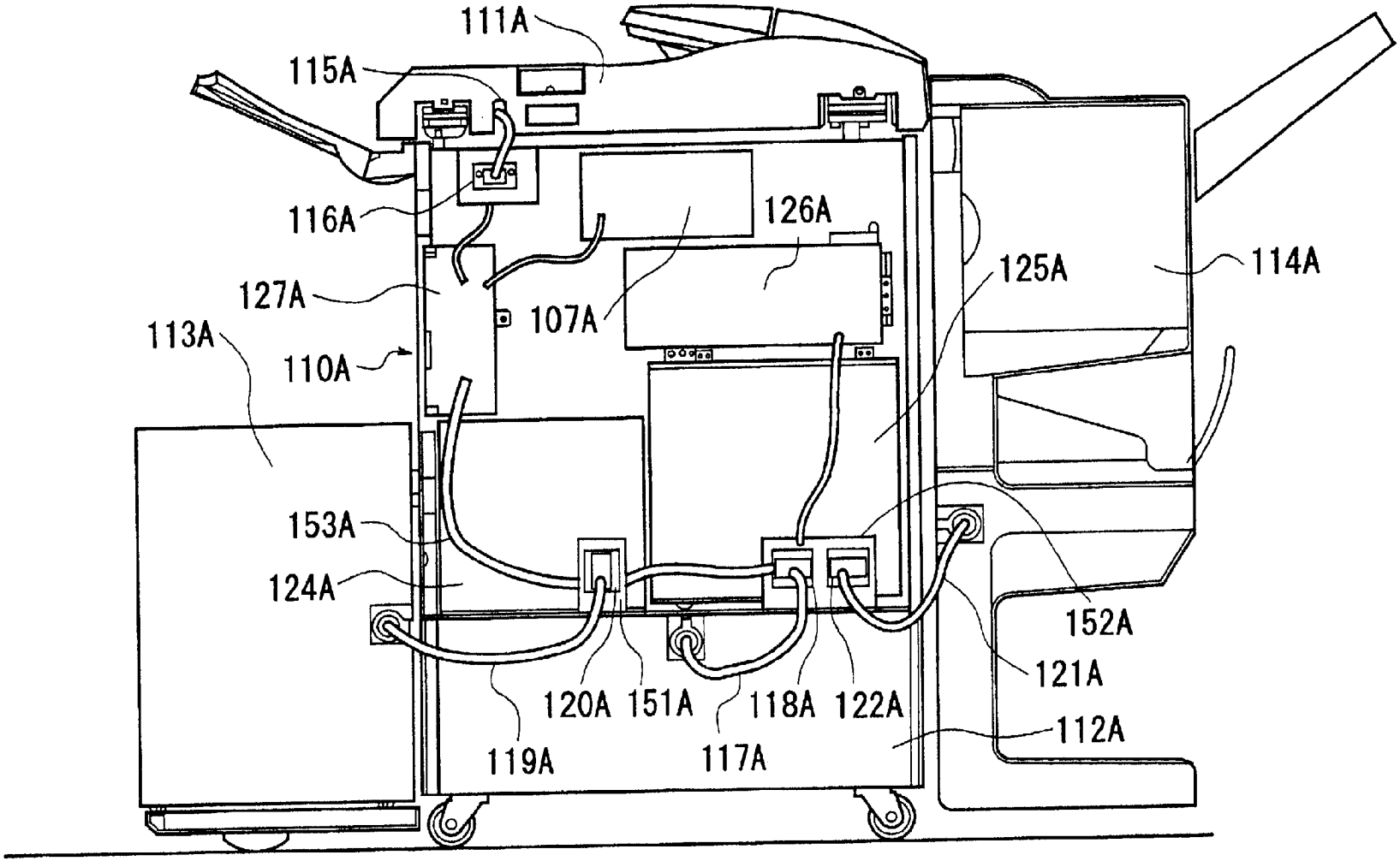
FIG. 10 is an illustration of a structure of an option voltage source in a conventional image forming apparatus.

Referring to FIGS. 6, 7, steps of mounting the option voltage source in the market will be described. As shown in FIG. 6 by (1), the option voltage source 127B and screws 138B for fixing it are prepared.

As shown in FIG. 7 by (2), the outer casing 123B at the rear side of the main assembly is removed. After the outer casing 123B is removed, the option voltage source 127B is fixed to the main voltage source 124B by screws 138B, as shown in FIG. 7 by (3). Thereafter, as shown in FIG. 5 by (4), the sixth voltage source cable 136B is connected to the main voltage source 124B by the sixth connector 144B.

As shown in FIG. 7 by (5), a cable clamp 141B is removed, and the voltage source cable 140B is taken out. As shown in FIG. 7 by (6), tv FIG. 7 vis connected to the fifth connector 135B.

After the fifth connector 135B is connected, a blind cover 142B in the outer casing 123B which has been removed is dismounted from the outer casing 123B by unthreading two screws, as shown in FIG. 7 by (7).

The blind cover 142B functions to blind the opening 143B for the third connector 120B and the fourth connector 122B provided in the option voltage source in the case that option voltage source is not used. As shown in FIG. 7 by (8), the outer casing 123B is fixed to the main assembly 110B of the apparatus.

In this manner, the option voltage source is mounted into the main assembly of the apparatus in the market. In the manufacturing step, it is not necessary to remove the blind cover 142B shown in FIG. 7 by (7).

Figure 11:
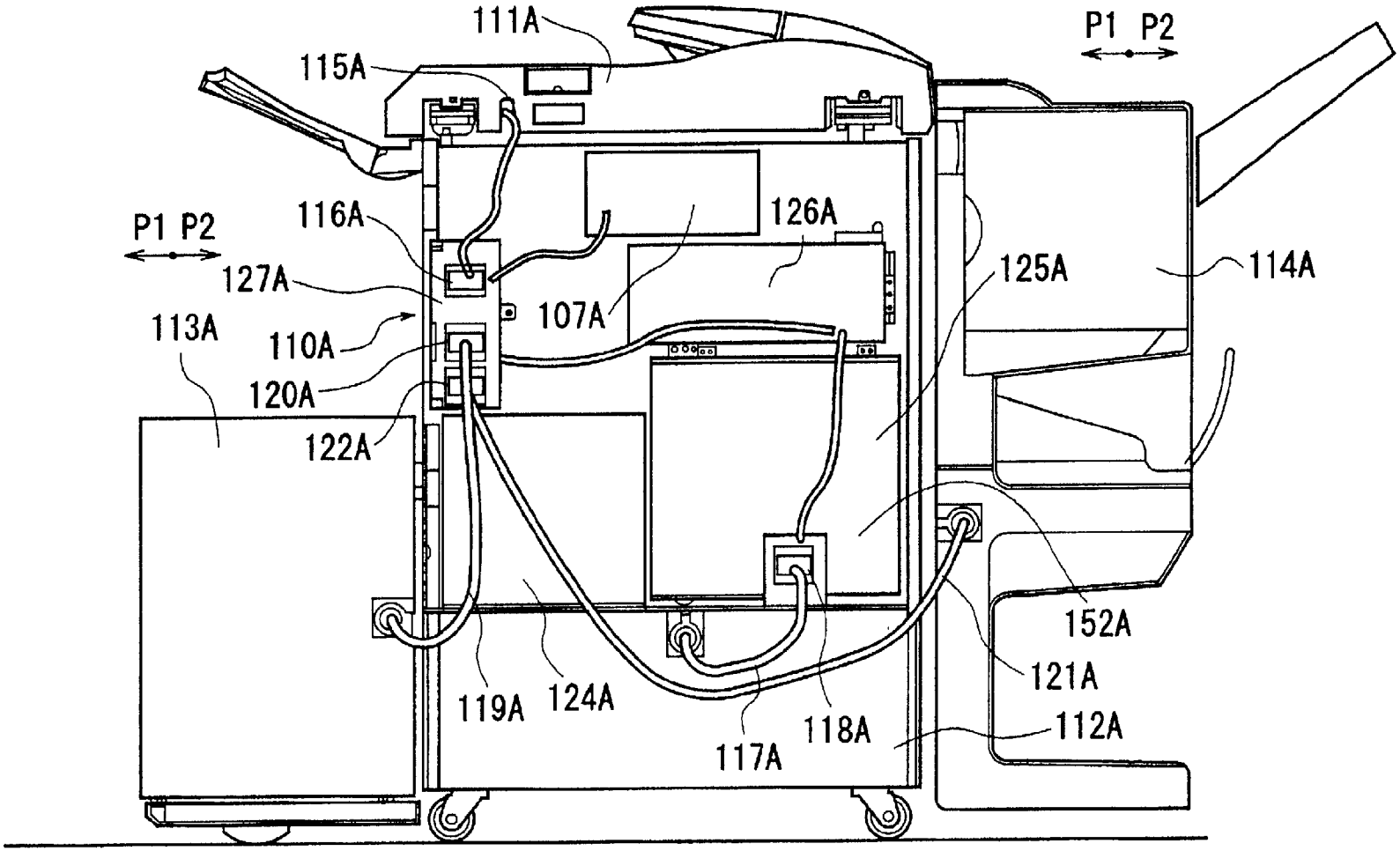
FIG. 11 is a rear view of an image forming apparatus according to a second embodiment of the present invention.

A second embodiment will be described. Depending on the utilization ratios of the reader apparatus and the original feeder apparatus, the electric power therefor may be supplied from the option voltage source as shown in FIG. 11. If the utilization ratio of the option apparatus connected to the option voltage source is the same, the advantage of unnecessity of the mounting and demounting operation of the connector is more significant than the disadvantage of cost increase in the option power unit due to the provision of the connectors for the reader apparatus and the original feeder apparatus. In such a case, if variations are given to the reader apparatus and the original feeder apparatus which require longer cables, the option power unit has to have performance enough to meet the variations. Therefore, it is desirable that reader apparatus and the original feeder apparatus are supplied with the electric power separately from the voltage source for the paper deck apparatus, finishing apparatus and the pedestal apparatus.

As described in the foregoing, according to the present invention, voltage supply structure for the option apparatus to be connected with the copying image forming apparatus is such that voltage supply for the feeder apparatus 111B is from the reader apparatus 105B, and the option power unit integral with the connector is mountable to the printer 106B for the voltage supply to paper deck apparatus 113A and the finishing apparatus 114B. Therefore, the power unit and the connector can be provided in accordance with the necessity of the option apparatus, thus accomplishing the improvement in the operativity for mounting the power unit, the cost reduction and the improvement in the operativity of the image forming apparatus. In the case that reader apparatus and the original feeder apparatus are supplied with the electric power from a voltage source different from the option power unit for supplying the electric power to the paper deck apparatus, pedestal apparatus and the finishing apparatus, the latitude in the disposition of the option power unit is increased. By disposing it at a proper position, the cable between the main assembly of the apparatus and the option apparatus is short, and therefore, the cost of the cable and the noise produced by the cable can be reduced.

The dimensions, materials, configurations, relative disposition among them or the like of the constituent elements in the foregoing description, are not limiting in the present invention, except that description to that effect is particularly made.

While the invention has been described with reference to the structures disclosed herein, it is not confined to the details set forth and this application is intended to cover such modifications or changes as may come within the purpose of the improvements or the scope of the following claims.

What is claimed is:

1. An image forming apparatus comprising:

an image forming station, provided in a main assembly of the image forming apparatus, for forming an image on a recording material;

an option device mounting portion to which a plurality of kinds of option devices are detachably mountable;

an option voltage source mounting portion to which an option voltage source corresponding to an option device mounted to said option device mounting portion is detachably mountable; and a main voltage source portion for supplying a voltage to a voltage receiving portion which is selectable in accordance with the plurality of kinds of option devices.

2. An image forming apparatus according to claim 1, wherein to one of said plurality of option devices, another option device is mountable, and in said one of said plurality of option devices, a second option voltage source portion for supplying electric power to said another option device is provided.

3. An image forming apparatus according to claim 1, wherein the voltage receiving portion is provided in such one of plural option devices simultaneously mounted to said option device mounting portion as is not supplied with the voltage from said option voltage source portion.

4. Am image forming apparatus according to claim 1, wherein each option device includes a cable for supplying a voltage, and each corresponding option voltage source has a connector portion to which the cable is electrically connectable.

5. Am image forming apparatus according to claim 2, wherein said plurality of kinds of option devices includes a reading device for reading information from an original, and a document feeder for feeding an original to said reading apparatus.

* * * * *

UNITED STATES PATENT AND TRADEMARK OFFICE

CERTIFICATE OF CORRECTION

PATENT NO. : 6,826,377 B2
DATED : November 30, 2004
INVENTOR(S) : Kitozaki

It is certified that error appears in the above-identified patent and that said Letters Patent is hereby corrected as shown below:

Column 2,
Line 7, “in” should read -- is --.
Line 31, “apparatus (11A,” should read -- apparatus (111A, --; and “Driving.” should be deleted.

Column 4,
Line 27, “to” should read -- into --.

Column 5,
Line 3, “are” should read -- be --.
Line 15, “13B is” should read -- 113B is --.
Lines 33 and 60, “t” should read -- the --.
Line 66, “is” (second occurrence) should read -- be --.

Column 6,
Lines 1 and 14, “t” should read -- the --.
Line 13, “th” should read -- the --.
Line 54, “neighborhood” should read -- in the neighborhood of --.
Line 56, “cable” should read -- cables --.
Line 65, “y” should be deleted.

Column 7,
Line 42, “on a wheel chair.” should read -- in a wheelchair. --.
Line 64, “inn” should read -- in --.

Column 8,
Line 14, “inn” should read -- in --.
Line 28, “tv FIG. 7 vis” should read -- the voltage source cable 140B is --.
Line 59, “are” should read -- be --.

UNITED STATES PATENT AND TRADEMARK OFFICE

CERTIFICATE OF CORRECTION

PATENT NO. : 6,826,377 B2
DATED : November 30, 2004
INVENTOR(S) : Kitozaki

It is certified that error appears in the above-identified patent and that said Letters Patent is hereby corrected as shown below:

Column 10,
Lines 21 and 26, "Am" should read -- An --.

Signed and Sealed this

First Day of November, 2005

JON W. DUDAS
*Director of the United States Patent and Trademark Office*